US010179714B2

(12) United States Patent
Tsuda et al.

(10) Patent No.: US 10,179,714 B2
(45) Date of Patent: Jan. 15, 2019

(54) ROLLER, ROLLER UNIT, PAPER FEEDER PROVIDED WITH ROLLER OR ROLLER UNIT, AND IMAGE READER

(71) Applicant: Panasonic Intellectual Property Management Co., Ltd., Osaka (JP)

(72) Inventors: Terumi Tsuda, Fukuoka (JP); Takefusa Ogata, Fukuoka (JP); Hiroshi Kusuda, Fukuoka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/416,381

(22) Filed: Jan. 26, 2017

(65) Prior Publication Data

US 2017/0225916 A1 Aug. 10, 2017

(30) Foreign Application Priority Data

Feb. 9, 2016 (JP) ..... 2016-022742
Mar. 9, 2016 (JP) ..... 2016-046001

(51) Int. Cl.
*B65H 3/06* (2006.01)
*B65H 3/52* (2006.01)

(52) U.S. Cl.
CPC ..... *B65H 3/0638* (2013.01); *B65H 3/0607* (2013.01); *B65H 3/5215* (2013.01); *B65H 3/5261* (2013.01); *B65H 2401/10* (2013.01); *B65H 2401/115* (2013.01); *B65H 2404/11* (2013.01); *B65H 2404/117* (2013.01); *B65H 2404/1122* (2013.01); *B65H 2404/187* (2013.01)

(58) Field of Classification Search
CPC ..... B65H 2404/1122; B65H 2404/11; B65H 2404/117; B65H 3/0638
See application file for complete search history.

(56) References Cited

U.S. PATENT DOCUMENTS 1,451,517 A * 4/1923 Smith ..... B60B 9/08 152/11
4,823,689 A * 4/1989 Kishino ..... F16C 13/00 100/155 R
6,769,679 B2 8/2004 Ishibashi
9,108,470 B2 * 8/2015 Tercha ..... B60C 7/08
(Continued)

FOREIGN PATENT DOCUMENTS

CH 700623 A1 * 9/2010 ..... B65H 29/12
JP 62-251516 A 11/1987
(Continued)

*Primary Examiner* — Howard J Sanders
(74) *Attorney, Agent, or Firm* — Seed IP Law Group LLP

(57) ABSTRACT

A retarding roller (a roller) is formed of a synthetic rubber (an industrial rubber material) such as ethylene propylene diene M-class rubber (EPDM) or polyurethane, or alternatively, silicone. The roller core of the retarding roller is cylindrical. M arc-shaped long holes (where M is an integer greater than or equal to 4) are formed in each of N layers (where N is an integer greater than or equal to 2) from a first layer (an outermost layer) to an Nth layer (an innermost layer) which are circular and concentric to a center axial line. In each layer, long holes are formed such that spokes in adjacent layers (an ith layer and an i+1th layer, where i is an integer from 1 to N−1) do not overlap in the circumferential direction.

18 Claims, 10 Drawing Sheets

(56) References Cited

U.S. PATENT DOCUMENTS

| | | | | |
|---|---|---|---|---|
| 2003/0193127 | A1 | 10/2003 | Ishibashi | |
| 2004/0163558 | A1* | 8/2004 | Itoh | B65H 5/062 101/232 |
| 2010/0033774 | A1* | 2/2010 | Ridl | B65H 1/04 358/498 |
| 2014/0210922 | A1 | 7/2014 | Stephens et al. | |

FOREIGN PATENT DOCUMENTS

| | | | |
|---|---|---|---|
| JP | 2003-300640 | A | 10/2003 |
| JP | 2005-82376 | A | 3/2005 |
| JP | 2015-224094 | A | 12/2015 |

* cited by examiner

ROLLER, ROLLER UNIT, PAPER FEEDER PROVIDED WITH ROLLER OR ROLLER UNIT, AND IMAGE READER

BACKGROUND

1. Technical Field

The present disclosure relates to a roller or a roller unit of an image scanner, a facsimile, or the like, for example, a paper feeder provided with the roller or the roller unit, and an image reader.

2. Description of the Related Art

In recent years image readers with a paper feeder such as an automatic document feeder (ADF) installed thereon are in common use. A separation roller and a retarding roller, on the opposite side from the separation roller, are disposed in the middle of a document transport path of the paper feeder in order to prevent the feeding of multiple document sheets.

The document which is transported to the separation roller is pinched by the separation roller and the retarding roller. At this time, if two documents enter the space between the separation roller and the retarding roller together, the transportation of the document which comes into contact with the retarding roller, which is rotating backward or is stationary, is prevented, and only the topmost document is separated from the other document and is fed out.

In order to reliably separate the documents, it is necessary to render the area (the nipping amount) over which the separation roller and the retarding roller come into contact with the documents sufficiently large to obtain a sufficient friction force for the retarding roller. Therefore, flexibility is demanded of the retarding roller such that the portion of the retarding roller which comes into contact with the separation roller easily warps. Wear resistance is also demanded of the retarding roller in order to suppress running costs.

Japanese Patent Unexamined Publication No. 2005-82376 discloses a retarding roller which is formed of two types of material in order to realize both flexibility and wear resistance. With this retarding roller, the roller is formed of soft urethane to secure flexibility, and the outer circumferential surface of the roller is covered with ethylene propylene diene M-class rubber (EPDM) to secure wear resistance.

SUMMARY

An object of the disclosure is to obtain a sufficient nipping amount even if the retarding roller is formed of a single material having sufficient wear resistance.

A roller of the disclosure includes a cylindrical roller, in which M arc-shaped long holes (where M is an integer greater than or equal to 4) are formed in each of N layers (where N is an integer greater than or equal to 2) which are circular and concentric to a center axial line of the roller such that spokes between the long holes in each layer do not overlap in a circumferential direction between adjacent layers.

According to the disclosure, it is possible to obtain a sufficient nipping amount even if the roller is formed of a single material having sufficient wear resistance.

DETAILED DESCRIPTION

Hereinafter, detailed description will be given of the exemplary embodiments of the disclosure with reference to the drawings.

Exemplary Embodiment 1

Figure 1:
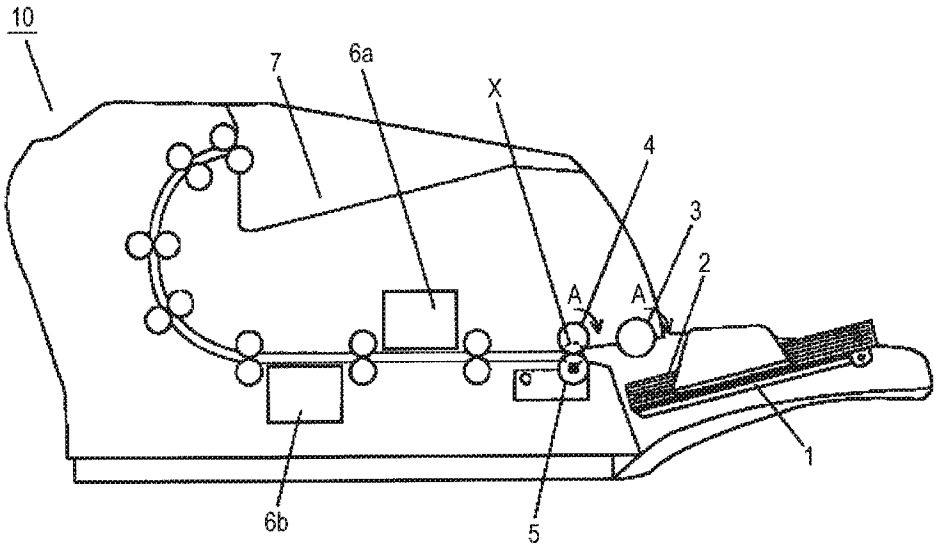
FIG. 1 is a schematic diagram of an image reader, installed on which is a paper feeder provided with a roller according to exemplary embodiment 1 of the disclosure.

FIG. 1 is a schematic diagram of an image reader, installed on which is a paper feeder provided with a roller (retarding roller 5) according to exemplary embodiment 1 of the disclosure. In image reader 10 of FIG. 1, the parts including paper feed roller 3, separation roller 4, and retarding roller 5 configure the paper feeder.

When image reader 10 of FIG. 1 starts a reading operation, document placement stand 1 uses a lift mechanism to lift document 2 which is placed on document placement stand 1 to a position at which document 2 comes into contact with paper feed roller 3. At this time, document 2 is biased by paper feed roller 3 by a predetermined pressure.

Paper feed roller 3 and separation roller 4 are rotationally driven by a motor, and rotate in a document feeding direction (arrow A direction). Document 2 is pulled inside the apparatus together with the rotation of paper feed roller 3, and enters a nipping portion X between separation roller 4 and retarding roller 5.

In a case in which retarding roller 5 is in direct contact with separation roller 4, retarding roller 5 follows separation roller 4 to rotate in the paper feeding direction. Even in a case in which only a single document 2 enters nipping portion X, retarding roller 5 follows document 2 to rotate in the paper feeding direction, and document 2 proceeds. Meanwhile, in a case in which two or more documents enter nipping portion X, since the inter-sheet friction of documents 2 is smaller than the friction between separation roller 4 and a first document 2 and the friction between retarding roller 5 and a second document 2, only the first document 2 which is in contact with separation roller 4 is separated from the second document onward to proceed.

Image reader 10 uses imaging devices 6*a* and 6*b* to read images of document 2 which passes nipping portion X, and subsequently outputs document 2 to output portion 7.

Figure 2:
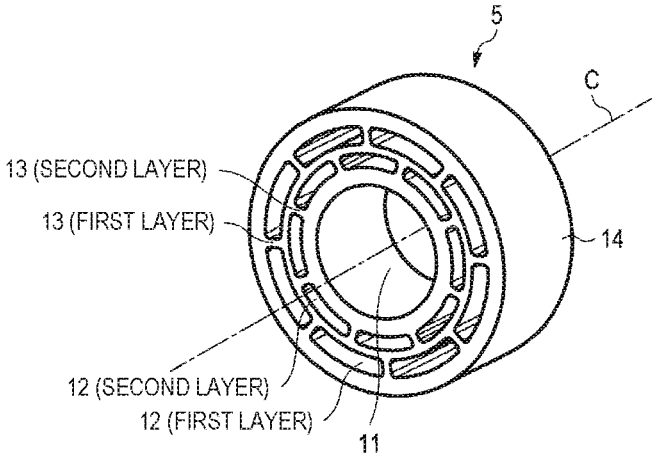
FIG. 2 is a perspective diagram of a roller according to exemplary embodiment 1 of the disclosure.
Figure 3:
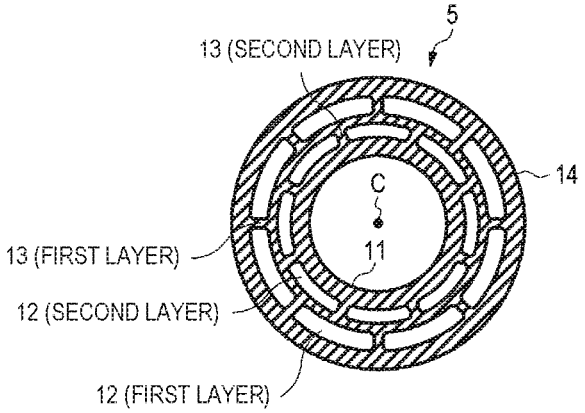
FIG. 3 is a front view of the roller according to exemplary embodiment 1 of the disclosure.

Next, description will be given of a roller (retarding roller 5) according to the exemplary embodiment using FIG. 2 (a perspective diagram), and FIG. 3 (a front view).

Retarding roller 5 (the roller) is formed of a synthetic rubber (an industrial rubber material) such as ethylene propylene diene M-class rubber (EPDM) or polyurethane, or alternatively, silicone. The synthetic rubber and the silicone have sufficient wear resistance, are deformed by a comparatively small external force, and have the elasticity to swiftly return to the original shape when the external force is released.

Retarding roller 5 is cylindrical. The inner diameter of the cylinder is from 10 to 36 mm inclusive, the outer diameter is 24 to 56 mm inclusive, and the outer diameter is greater than or equal to 14 mm larger than the inner diameter. When retarding roller 5 is attached to the paper feeder, a rotating shaft is inserted into a central through hole 11 (an inner circumferential surface). Alternatively, a rotating shaft and a cylindrical sleeve (a wheel) are inserted into a central through hole 11 (an inner circumferential surface).

In retarding roller 5, M arc-shaped long holes 12 (where M is an integer greater than or equal to 4, M=8 in FIGS. 2 and 3) are formed in each of N layers (where N is an integer greater than or equal to 2, N=2 in FIGS. 2 and 3) from a first layer (the outermost layer) to an Nth layer (the innermost layer) which are circular and concentric to center axial line C. Spokes 13 which are between long holes 12 in each layer have a length of 1 mm or greater in the circumferential direction.

In each layer, it is preferable that long holes 12 are formed at an equal interval, and it is preferable that long holes 12 are formed in the same shape. It is preferable that the length of long holes 12 in the circumferential direction in an ith layer (where i is an integer from 1 to N−1) is longer than long holes 12 of the i+1th layer. It is preferable that the length (width) of long holes 12 in the ith layer in the radial direction is longer than long holes 12 of the i+1th layer.

Long holes 12 are formed such that spokes 13 in adjacent layers (an ith layer and an i+1th layer) do not overlap in the circumferential direction. In particular, it is preferable that long holes 12 are formed such that spokes 13 of the i+1th layer are present on a plane passing through the center of long holes 12 of the ith layer in the circumferential direction and center axial line C. In other words, it is preferable that long holes 12 are formed such that the distance from each of two adjacent spokes 13 in the ith layer to spoke 13 of the i+1th layer which is positioned between the two spokes 13 in the circumferential direction is equal.

Figure 4A:
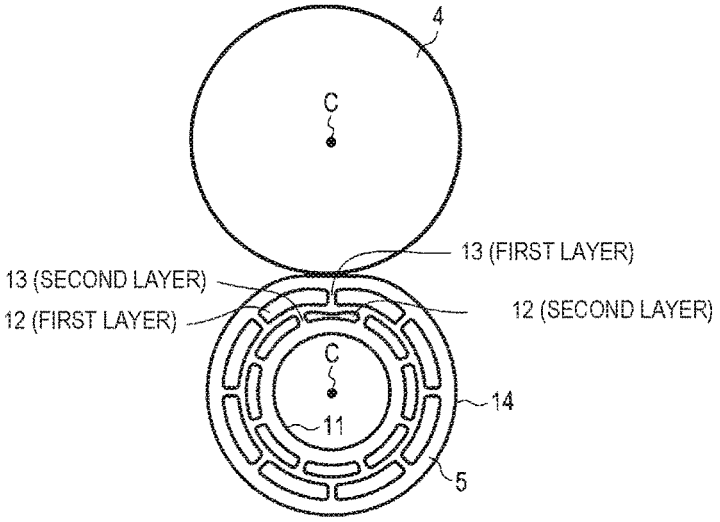
FIG. 4A is a diagram explaining a warped state of the roller according to exemplary embodiment 1 of the disclosure.
Figure 4B:
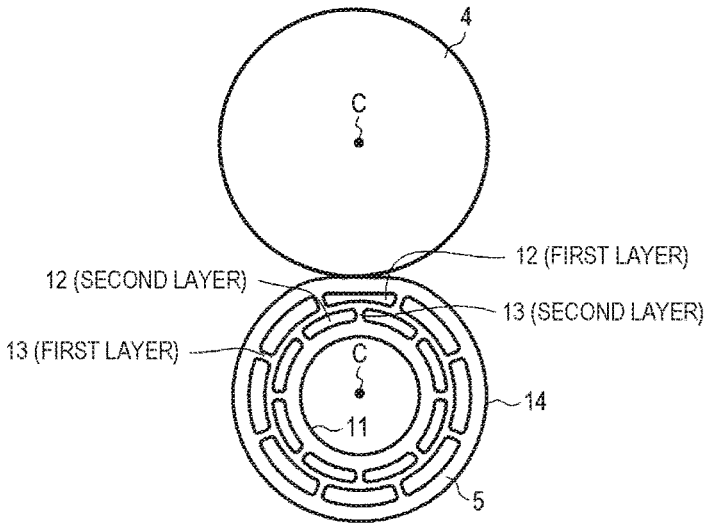
FIG. 4B is a diagram explaining a warped state of the roller according to exemplary embodiment 1 of the disclosure.
Figure 5:
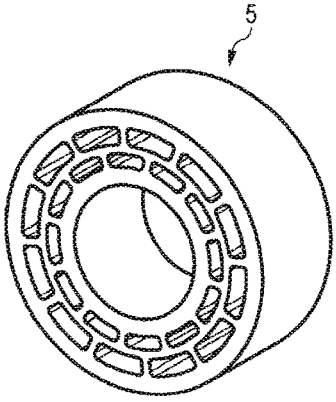
FIG. 5 is a perspective diagram of the roller according to exemplary embodiment 1 of the disclosure.
Figure 6:
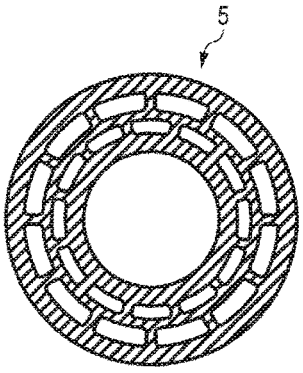
FIG. 6 is a front view of the roller according to exemplary embodiment 1 of the disclosure.
Figure 7A:
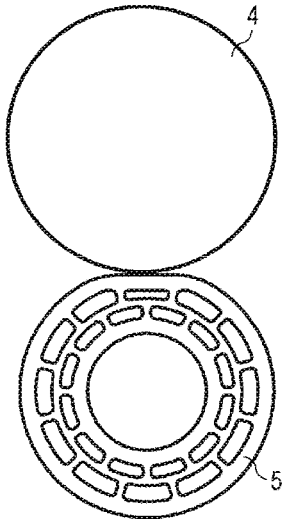
FIG. 7A is a diagram explaining a warped state of the roller according to exemplary embodiment 1 of the disclosure.
Figure 7B:
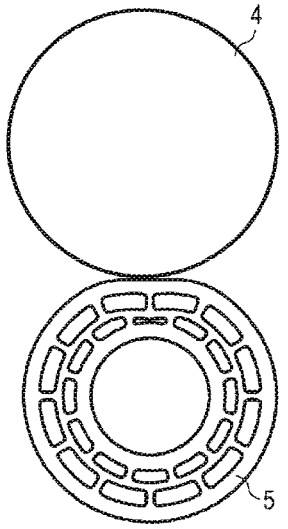
FIG. 7B is a diagram explaining a warped state of the roller according to exemplary embodiment 1 of the disclosure.

Next, description will be given of a warped state of retarding roller 5 using FIGS. 4A and 4B. FIG. 4A is a diagram explaining a warped state of the roller according to exemplary embodiment 1 of the disclosure, and indicates a case in which retarding roller 5 is in direct contact with separation roller 4 in a state in which spoke 13 of the first layer (the outermost layer) is present on a plane which passes through center axial line C of separation roller 4 and center axial line C of retarding roller 5. FIG. 4B is a diagram explaining a warped state of the roller according to exemplary embodiment 1 of the disclosure, and indicates a case in which retarding roller 5 is in direct contact with separation roller 4 in a state in which the center of long hole 12 of the first layer (the outermost layer) is present on the plane which passes through center axial line C of separation roller 4 and center axial line C of retarding roller 5.

In the case of FIG. 4A, due to long hole 12 of the second i layer deforming so as to be depressed, the abutting portion of outer circumferential surface 14 of retarding roller 5 warps to fit to the exterior shape of separation roller 4, and the area (the nipping amount) of retarding roller 5 which is in contact with separation roller 4 is increased.

In the case of FIG. 4B, due to long hole 12 of the second i−1 layer deforming so as to be depressed, the abutting portion of outer circumferential surface 14 of retarding roller 5 warps to fit to the exterior shape of separation roller 4, and the area (the nipping amount) of retarding roller 5 which is in contact with separation roller 4 is increased.

In FIG. 4A, when the surface of the roller corresponding to spokes 13 of the first layer (the outermost layer) of retarding roller 5 comes into contact with separation roller 4, in addition to the depression of long holes 12 of the second layer which is on the inner diameter side of the first layer, the depression of long holes 12 of the first layer which is adjacent to spokes 13 is applied. Therefore, in order to obtain nipping which is closer to uniform along the entire circumference of retarding roller 5, it is desirable for the width of long holes 12 of the second layer in the radial direction of retarding roller 5 to be smaller than the width of long holes 12 of the first layer in the radial direction of retarding roller 5. In other words, it is desirable for the length (the width) of long holes 12 of an ith layer (i is an integer from 1 to N−1) in the radial direction of retarding roller 5 to be longer than the length (the width) of long holes 12 of an i+1th layer in the radial direction of retarding roller 5. Accordingly, nipping which is closer to uniform may be obtained along the entire circumference of retarding roller 5.

In FIGS. 2 to 4B, retarding roller 5 in which the number N of layers is 2 and the number M of long holes 12 of each layer is 8 is illustrated; however, the exemplary embodiment is not limited thereto, and N may be an integer greater than or equal to 2, and M may be an integer greater than or equal to 4. In FIGS. 5 to 7B, retarding roller 5 in which the number N of layers is 2 and the number M of long holes 12 in each layer is 12 is illustrated.

In this manner, according to the exemplary embodiment, M arc-shaped long holes are formed in each of N layers which are circular and concentric to the center axial line of retarding roller 5 (the roller) such that the spokes between the long holes in each layer do not overlap in the circumferential direction between adjacent layers. Accordingly, even if retarding roller 5 is formed of a single material which has sufficient wear resistance, since the portion of retarding roller 5 which comes into contact with separation roller 4 warps easily, it is possible to increase the area (the nipping amount) which comes into contact with the document which is transported, and it is possible to obtained sufficient friction force.

If the long holes which are formed in the retarding roller are only in one layer, the pressure applied to the document becomes uneven depending on the position at which contact is made with the retarding roller. As in the exemplary embodiment, by forming long holes 12 in two or more layers in retarding roller 5, it is possible to render the pressure applied to document 2 uniform.

Figure 8:
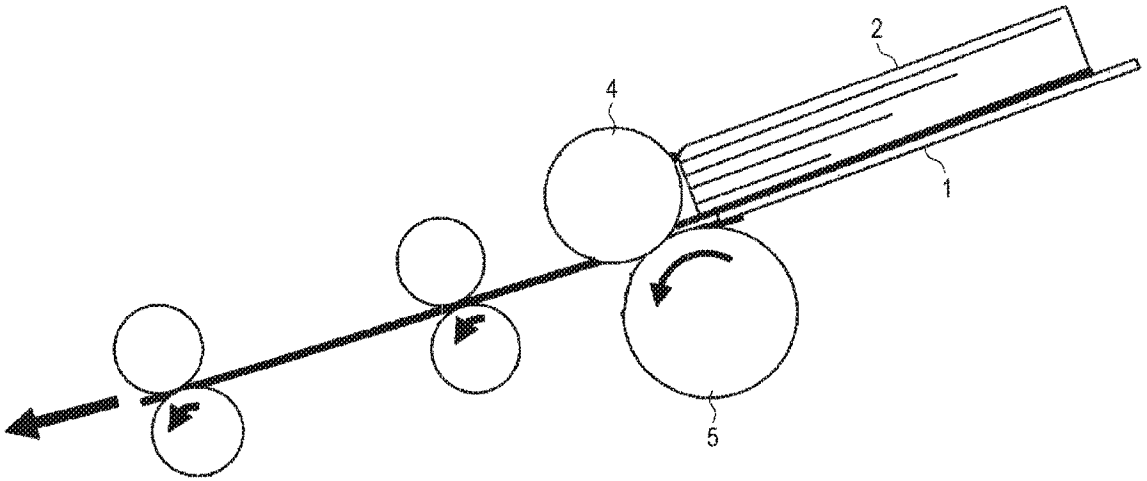
FIG. 8 is a schematic diagram of a bottom pick-up system paper feeder provided with the roller according to exemplary embodiment 1 of the disclosure.

By using silicone with favorable sliding properties as the material of the roller, particularly in a bottom pick-up system paper feeder which picks up sheets sequentially from the bottommost document 2 to perform the paper feeding, as illustrated in FIG. 8, the separation characteristics of document 2 are improved.

Exemplary Embodiment 2

In exemplary embodiment 1, description is given of a case in which the wheel is an ordinary cylindrical shape, and the characteristics of the shape of the roller are modified. In exemplary embodiment 2, description is given of a case in which the characteristics of the shape of the wheel are modified.

Figure 9:
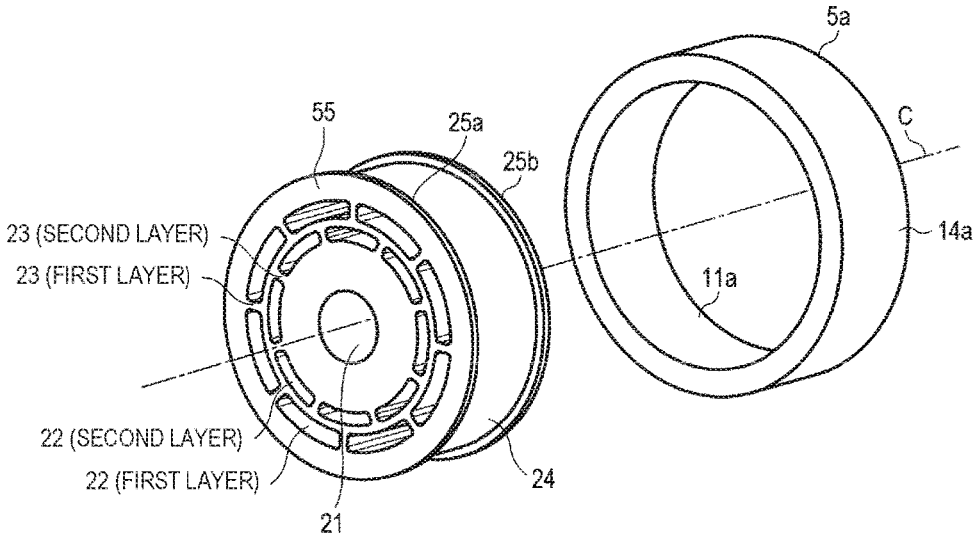
FIG. 9 is an exploded perspective diagram of a roller unit according to exemplary embodiment 2 of the disclosure.
Figure 10:
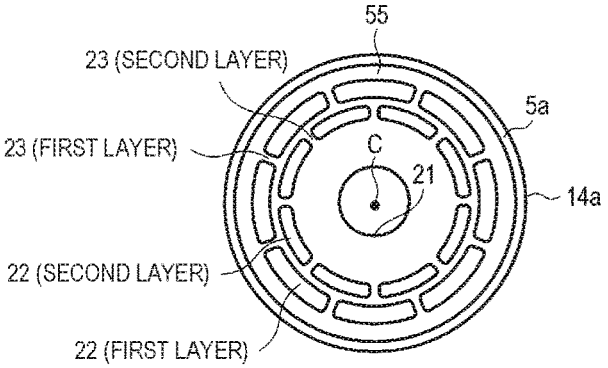
FIG. 10 is a front view of the roller unit according to exemplary embodiment 2 of the disclosure.

Hereinafter, description is given of the roller unit according to the exemplary embodiment using FIG. 9 (an exploded perspective diagram) and FIG. 10 (a front view). The roller unit is formed of wheel 55 and retarding roller 5*a*.

Wheel 55 (the wheel substrate) is formed of a resin material with elasticity such as polypropylene, or nylon 66. Wheel 55 is cylindrical. The inner diameter of the cylinder is from 5 to 31 mm inclusive, the outer diameter is from 19 to 51 mm inclusive, and the outer diameter is greater than or equal to 14 mm larger than the inner diameter. When wheel 55 is attached to the paper feeder, a rotating shaft is inserted into through hole 21 (the inner circumferential surface) of the center.

In wheel 55, M arc-shaped long holes 22 (where M is an integer greater than or equal to 4, M=8 in FIGS. 9 and 10) are formed in each of N layers (where N is an integer greater than or equal to 2, N=2 in FIGS. 9 and 10) from a first layer (the outermost layer) to an Nth layer (the innermost layer) which are circular and concentric to center axial line C. The length of spokes 23 in the circumferential direction between long holes 22 in each layer is greater than or equal to 1 mm.

In each layer, it is preferable that long holes 22 are formed at an equal interval, and it is preferable that long holes 22 are formed in the same shape. It is preferable that the length of long holes 22 in the circumferential direction in an ith layer (where i is an integer from 1 to N−1) is longer than long holes 22 of the i+1th layer. It is preferable that the length (the width) of long hole 22 of the ith layer in the radial direction is longer than that of long hole 22 of the i+1th layer.

Long holes 22 are formed such that spokes 23 in adjacent layers (an ith layer and an i+1th layer) do not overlap in the circumferential direction. In particular, it is preferable that long holes 22 are formed such that spokes 23 of the i+1th layer are present on a plane passing through the center of long holes 22 of the ith layer in the circumferential direction and center axial line C. In other words, it is preferable that long holes 22 are formed such that the distance from each of two adjacent spokes 23 in the ith layer to spoke 23 of the i+1th layer which is positioned between the two spokes 23 in the circumferential direction is equal.

Both ends 25*a* and 25*b* of outer circumferential surface 24 of wheel 55 are protruding circles with a larger diameter than the other portions of outer circumferential surface 24.

Retarding roller 5*a* (the roller core) is formed of silicone. Retarding roller 5*a* is cylindrical. The inner diameter of the cylinder is from 19 to 51 mm inclusive, the outer diameter is 24 to 56 mm inclusive, and the outer diameter is greater than or equal to 5 mm larger than the inner diameter.

The inner diameter of retarding roller 5*a* is slightly smaller than the diameter of outer circumferential surface 24 of wheel 55. The width of retarding roller 5*a* is substantially equal to the distance between the inner surfaces of both ends 25*a* and 25*b* of outer circumferential surface 24 of wheel 55. In a case in which retarding roller 5*a* is attached to wheel 55, outer circumferential surface 24 of wheel 55 and inner circumferential surface 11*a* of retarding roller 5*a* are in contact with each other over the entire surfaces thereof.

Figure 11A:
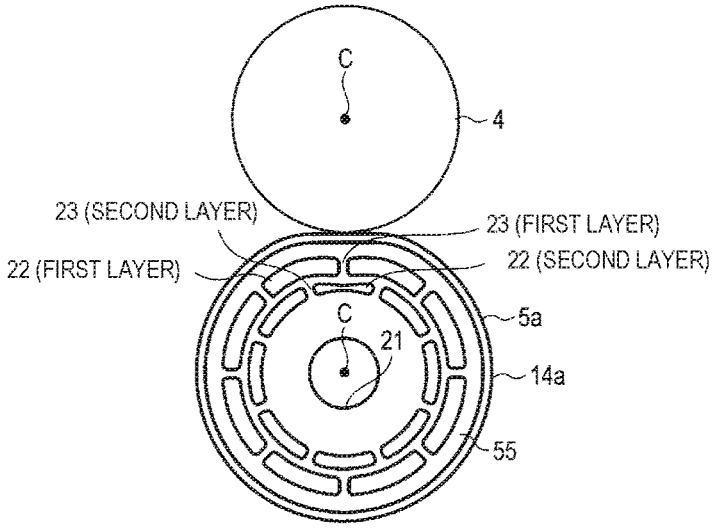
FIG. 11A is a diagram explaining a warped state of the roller unit according to exemplary embodiment 2 of the disclosure.
Figure 11B:
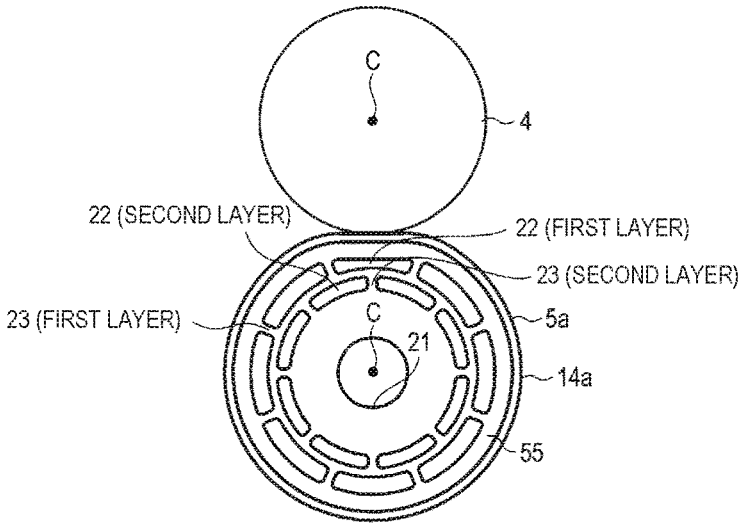
FIG. 11B is a diagram explaining a warped state of the roller unit according to exemplary embodiment 2 of the disclosure.
Figure 12:
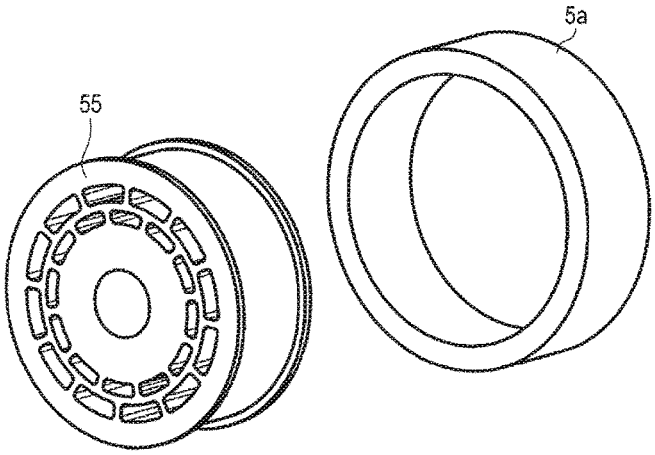
FIG. 12 is a perspective diagram of the roller unit according to exemplary embodiment 2 of the disclosure.
Figure 13:
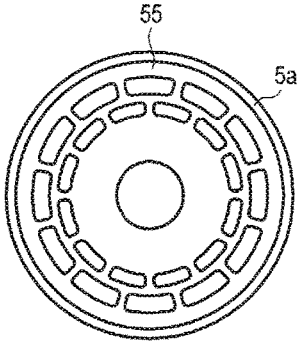
FIG. 13 is a front view of the roller unit according to exemplary embodiment 2 of the disclosure.
Figure 14A:
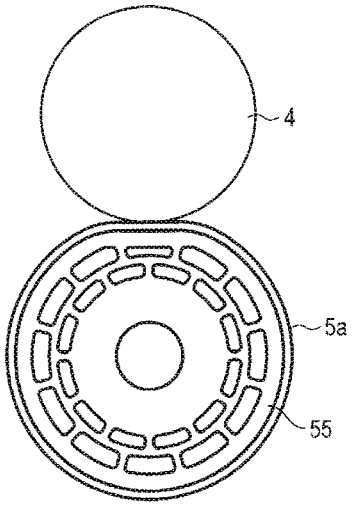
FIG. 14A is a diagram explaining a warped state of the roller unit according to exemplary embodiment 2 of the disclosure.
Figure 14B:
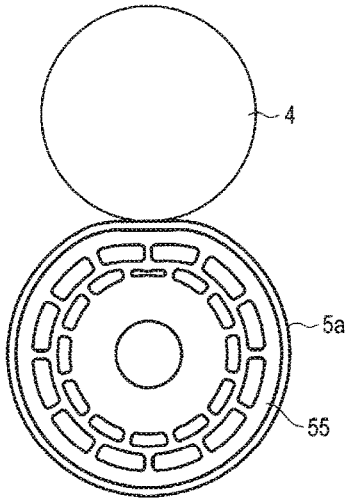
FIG. 14B is a diagram explaining a warped state of the roller unit according to exemplary embodiment 2 of the disclosure.

Next, description will be given of a warped state of a roller unit using FIGS. 11A and 11B. FIG. 11A indicates a case in which retarding roller 5*a* is in direct contact with separation roller 4 in a state in which spoke 23 of the first layer (the outermost layer) is present on a plane which passes through center axial line C of separation roller 4 and center axial line C of wheel 55. FIG. 11B indicates a case in which retarding roller 5*a* is in direct contact with separation roller 4 in a state in which the center of long hole 22 of the first layer (the outermost layer) is present on a plane which passes through center axial line C of separation roller 4 and center axial line C of wheel 55.

In the case of FIG. 11A, due to long hole 22 of the second i layer deforming so as to be depressed, the abutting portion of outer circumferential surface 14*a* of retarding roller 5*a* warps to fit to the exterior shape of separation roller 4, and the area (the nipping amount) of retarding roller 5*a* which is in contact with separation roller 4 is increased.

In the case of FIG. 11B, due to long hole 22 of the second i−1 layer deforming so as to be depressed, the abutting portion of outer circumferential surface 14*a* of retarding roller 5*a* warps to fit to the exterior shape of separation roller 4, and the area (the nipping amount) of retarding roller 5*a* which is in contact with separation roller 4 is increased.

In FIGS. 9 to 11B, wheel 55 in which the number N of layers is 2 and the number M of long holes 22 of each layer is 8 is illustrated; however, the exemplary embodiment is not limited thereto, and N may be an integer greater than or equal to 2, and M may be an integer greater than or equal to 4. In FIGS. 12 to 14B, wheel 55 in which the number N of layers is 2 and the number M of long holes 22 in each layer is 12 is illustrated.

In the same manner as in exemplary embodiment 1, even in exemplary embodiment 2, in FIG. 11A, when the surface of the roller corresponding to spokes 23 of the first layer (the outermost layer) of retarding roller 5*a* comes into contact with separation roller 4, in addition to the depression of long holes 22 of the second layer which is on the inner diameter side of the first layer, the depression of long holes 22 of the first layer which is adjacent to spokes 23 is applied. Therefore, in order to obtain nipping which is closer to uniform along the entire circumference of retarding roller 5*a*, it is desirable for the width of long holes 22 of the second layer in the radial direction of retarding roller 5*a* to be smaller than the width of long holes 22 of the first layer in the radial direction of retarding roller 5*a*. In other words, it is desirable for the length (the width) of long holes 22 of an ith layer (i is an integer from 1 to N−1) in the radial direction of retarding roller 5*a* to be longer than the length (the width) of long holes 22 of an i+1th layer in the radial direction of retarding roller 5*a*. Accordingly, nipping which is closer to uniform may be obtained along the entire circumference of retarding roller 5*a*.

In this manner, according to the exemplary embodiment, in a roller unit in which a cylindrical retarding roller 5*a* is attached to wheel 55, M arc-shaped long holes are formed in each of N layers which are circular and concentric to the center axial line of wheel 55 such that the spokes between the long holes in each layer do not overlap in the circumferential direction between adjacent layers. Accordingly, even if retarding roller 5*a* is formed of a single material which has sufficient wear resistance, since the portion of retarding roller 5*a* which comes into contact with separation roller 4 warps easily, it is possible to increase the area (the nipping amount) which comes into contact with the document which is transported, and it is possible to obtained sufficient friction force.

According to the exemplary embodiment, since it is possible to render retarding roller 5*a*, which is a consumable, a simple cylindrical shape, it is possible to suppress costs.

If the long holes which are formed in the wheel are only in one layer, the pressure applied to the document becomes uneven depending on the position at which contact is made with the retarding roller. As in the exemplary embodiment, by forming long holes 22 in two or more layers in wheel 55, it is possible to render the pressure applied to document 2 uniform.

The abovementioned description is given of an exemplary embodiment with reference to the drawings, and it goes without saying that the disclosure is not limited to the examples given. It is clear to a person skilled in the art that various modifications and corrections may be made within the scope disclosed in the claims. Naturally, such modifications and corrections are understood to fall within the technical scope of the disclosure.

What is claimed is:

1. A rotationally driven retarding roller disposed adjacent to a rotationally driven separation roller in a paper feeder, the retarding roller comprising:

a cylindrical roller having a center axial line, the cylindrical roller including M arc-shaped long holes (where M is an integer greater than or equal to 4) in each of N layers (where N is an integer greater than or equal to 2) which are circular and concentric to the center axial line of the roller and spokes between the arc-shaped long holes in each layer, the spokes in one layer not overlapping in a circumferential direction with the spokes in an adjacent layer, wherein, when the roller is not deformed by an external force, a width of the arc-shaped long holes in an outermost one of the layers in a radial direction of the roller from a first end of each of the arc-shaped long holes in the circumferential direction to a second end thereof in the circumferential direction is uniform and is greater than a width of the arc-shaped long holes in one of the layers that is adjacent to the outermost one of the layers in the radial direction, and each of the spokes of the one of the layers that is adjacent to the outermost one of the layers extends along a plane passing through a center in the circumferential direction of one of the arc-shaped long holes of the outermost one of the layers and the center axial line, and wherein, when the cylindrical roller is in contact with the separation roller, an abutting portion of an outer circumferential surface of the cylindrical roller warps to fit to an exterior shape of the separation roller, and the cylindrical roller rotates to a position at which a deformed one of the arc-shaped long holes deforms along a plane which passes through a center axial line of the separation roller, the center axial line of the cylindrical roller, a center in the circumferential direction of the deformed one of the arc-shaped long holes, and at least one of the spokes.

2. The roller of claim 1, wherein the arc-shaped long holes in a layer are formed at an equal interval and are formed in the same shape.

3. The roller of claim 1, wherein the roller comprises a polyurethane or silicone.

4. The roller of claim 1, wherein the spokes have a length in the circumferential direction that is uniform.

5. The roller of claim 1, wherein the paper feeder further includes:

a paper feed roller; and wherein the retarding roller contacts the separation roller.

6. The roller of claim 5, wherein the paper feeder is included in an image reader that further includes:

a document placement stand; and an imaging device;

wherein the paper feeder is provided between the document placement stand and the imaging device.

7. The roller of claim 6, wherein in a case of starting a reading operation of a document which is placed on the document placement stand, the paper feed roller and the separation roller rotate in a feeding direction in which the document on the document placement stand is pulled toward the imaging device inside the image reader, and wherein, when the retarding roller is in contact with the separation roller, the retarding roller follows the separation roller to rotate in the feeding direction.

8. A rotationally driven retarding roller unit disposed adjacent to a rotationally driven separation roller in a paper feeder, the retarding roller unit comprising:

a roller; and a wheel having a center axial line, the wheel including M arc-shaped long holes (where M is an integer greater than or equal to 4) in each of N layers (where N is an integer greater than or equal to 2) which are circular and concentric to the center axial line of the wheel and spokes between the arc-shaped long holes in each layer, the spokes in one layer not overlapping in a circumferential direction with the spokes in an adjacent layer, wherein, when the wheel is not deformed by an external force, a width of the arc-shaped long holes in an outermost one of the layers in a radial direction of the wheel from a first end of each of the arc-shaped long holes in the circumferential direction to a second end thereof in the circumferential direction is uniform and is greater than a width of the arc-shaped long holes in one of the layers that is adjacent to the outermost one of the layers in the radial direction, and each of the spokes of the one of the layers that is adjacent to the outermost one of the layers extends along a plane passing through a center in the circumferential direction of one of the arc-shaped long holes of the outermost one of the layers and the center axial line, wherein an outer circumferential surface of the wheel is in contact with an inner circumferential surface of the roller, and wherein, when the roller is in contact with the separation roller, an abutting portion of an outer circumferential surface of the roller warps to fit to an exterior shape of the separation roller, and the wheel rotates to a position at which a deformed one of the arc-shaped long holes deforms along a plane which passes through a center axial line of the separation roller, the center axial line of the wheel, a center in the circumferential direction of the deformed one of the arc-shaped long holes, and at least one of the spokes.

9. The roller unit of claim 8, wherein the arc-shaped long holes in a layer are formed at an equal interval and are formed in the same shape.

10. The roller unit of claim 8, wherein the roller comprises silicone and the wheel comprises a resin material with elasticity.

11. The roller unit of claim 8, wherein the spokes have a length in the circumferential direction that is uniform.

12. The roller unit of claim 8, wherein the paper feeder further includes:

a paper feed roller; and wherein the roller contacts the separation roller.

13. The roller unit of claim 12, wherein the paper feeder is included in an image reader that further includes:

a document placement table; and an imaging device;

wherein the paper feeder is provided between the document placement table and the imaging device.

14. The roller unit of claim 13, wherein in a case of starting a reading operation of a document which is placed on the documents placement stand, the paper feed roller and the separation roller rotate in a feeding direction in which the document on the document placement stand is pulled toward the imaging device inside the image reader, and wherein, when the retarding roller is in contact with the separation roller, the retarding roller follows the separation roller to rotate in the feeding direction.

15. A rotationally driven retarding roller disposed adjacent to a rotationally driven separation roller in a paper feeder, the retarding roller comprising:

a cylindrical roller having an innermost layer that is circular and concentric to a center axial line of the roller, and an outermost layer that is circular and concentric to the center axial line of the roller, the innermost layer being adjacent to the outermost layer, wherein each of the innermost layer and the outermost layer includes at least four arc-shaped long holes and spokes between the arc-shaped long holes, the spokes in the innermost layer not overlapping in a circumferential direction with the spokes in the outermost layer, wherein, when the roller is not deformed by an external force, a width of the arc-shaped long holes in the outermost layer in a radial direction of the roller from a first end of each of the arc-shaped long holes in the circumferential direction to a second end thereof in the circumferential direction is uniform and is greater than a width of the arc-shaped long holes in the innermost layer in the radial direction, and each of the spokes of the one of the layers that is adjacent to the outermost one of the layers extends along a plane passing through a center in the circumferential direction of one of the arc-shaped long holes of the outermost one of the layers and the center axial line, and wherein, when the cylindrical roller is in contact with the separation roller, an abutting portion of an outer circumferential surface of the cylindrical roller warps to fit to an exterior shape of the separation roller, and the cylindrical roller rotates to a position at which a deformed one of the arc-shaped long holes deforms along a plane which passes through a center axial line of the separation roller, the center axial line of the cylindrical roller, a center in the circumferential direction of the deformed one of the arc-shaped long holes, and at least one of the spokes.

16. The roller of claim 15, wherein the arc-shaped long holes in the innermost layer are formed at equal intervals and are formed in the same shape, and wherein the arc-shaped long holes in the outermost layer are formed at equal intervals and are formed in the same shape.

17. The roller of claim 15, wherein the spokes have a length in the circumferential direction that is uniform.

18. The roller of claim 15, wherein the paper feeder further includes:

a paper feed roller; and wherein the retarding roller contacts the separation roller.

* * * * *